US010473408B2

(12) United States Patent
Kokas et al.

(10) Patent No.: US 10,473,408 B2
(45) Date of Patent: Nov. 12, 2019

(54) HEAT EXCHANGER WITH EMBEDDED HEAT PIPES

(71) Applicant: Hamilton Sundstrand Corporation, Charlotte, NC (US)

(72) Inventors: Jay W. Kokas, East Granby, CT (US); Leo J. Veilleux, Jr., Wethersfield, CT (US); Rudolph Thomas Beaupre, Southwick, MA (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 0 days.

(21) Appl. No.: 15/858,651

(22) Filed: Dec. 29, 2017

(65) Prior Publication Data

US 2018/0120038 A1 May 3, 2018

Related U.S. Application Data

(62) Division of application No. 13/952,287, filed on Jul. 26, 2013, now Pat. No. 9,863,716.

(51) Int. Cl.

| | |
|---|---|
| ***F28F 3/12*** | (2006.01) |
| ***F28D 15/04*** | (2006.01) |
| ***F28F 3/02*** | (2006.01) |
| ***F28D 9/00*** | (2006.01) |
| ***F28D 15/02*** | (2006.01) |

(52) U.S. Cl.

CPC ..... *F28F 3/12* (2013.01); *F28D 9/005* (2013.01); *F28D 15/0275* (2013.01); *F28D 15/04* (2013.01); *F28F 3/022* (2013.01); *F28F 2215/06* (2013.01)

(58) Field of Classification Search

CPC ..... F28D 9/00; F28D 9/0031; F28D 9/005; F28D 15/00; F28D 15/0275; F28D 15/02; F28D 15/04; F28D 15/0233; F28F 3/00; F28F 3/02; F28F 3/04; F28F 3/12;

(Continued)

(56) References Cited

U.S. PATENT DOCUMENTS 3,807,493 A 4/1974 Stewart
4,520,863 A 6/1985 Andres et al.

(Continued)

FOREIGN PATENT DOCUMENTS

EP 0212739 A1 * 3/1987 ..... F28D 15/02
EP 2381203 A1 10/2011

(Continued)

OTHER PUBLICATIONS

JP2008039311A Machine Translation (Year: 2008).*

(Continued)

*Primary Examiner* — Keith M Raymond
*Assistant Examiner* — Gustavo A Hincapie Serna
(74) *Attorney, Agent, or Firm* — Kinney & Lange, P.A.

(57) ABSTRACT

A heat exchanger is disclosed which includes a plurality of heat exchanger plates. Each plate has a plurality of hollowed out pins arranged in a pin fin pattern. Each plate also includes an inlet aperture and an outlet aperture in fluid communication with one another. A plurality of heat pipes are defined by several of the plurality of hollowed out pins. A wicking material is arranged within the several hollowed out pins. A heat transfer fluid at least partially fills each heat pipe.

9 Claims, 4 Drawing Sheets

(58) Field of Classification Search
CPC .. F28F 2013/001; F28F 13/00; F28F 2215/00; F28F 2215/06
USPC .... 165/104.11, 104.19, 104.21, 104.26, 164, 165/165, 166, 167
See application file for complete search history.

(56) References Cited

U.S. PATENT DOCUMENTS

| | | | | |
|---|---|---|---|---|
| 4,537,247 | A | 8/1985 | Okamoto et al. | |
| 4,875,522 | A * | 10/1989 | Noda | F28D 15/0275 165/104.14 |
| 5,181,167 | A | 1/1993 | Davidson et al. | |
| 5,329,993 | A | 7/1994 | Ettehadieh | |
| 5,845,399 | A | 12/1998 | Dewar et al. | |
| 5,931,219 | A | 8/1999 | Kull et al. | |
| 6,688,377 | B2 * | 2/2004 | Wang | F28D 15/0233 165/104.21 |
| 6,749,011 | B2 * | 6/2004 | Horng | F28F 1/30 165/80.3 |
| 6,843,307 | B2 | 1/2005 | Yuyama et al. | |
| 7,267,167 | B2 * | 9/2007 | Lee | F28D 15/0266 165/104.33 |
| 7,631,687 | B2 | 12/2009 | Yang | |
| 7,681,629 | B2 | 3/2010 | Yamaguchi et al. | |
| 8,002,021 | B1 | 8/2011 | Zuo et al. | |
| 8,187,559 | B2 | 5/2012 | Gruss et al. | |
| 8,300,759 | B2 | 10/2012 | Jeong et al. | |
| 9,533,372 | B2 | 1/2017 | O'Neill | |
| 2005/0077660 | A1 | 4/2005 | Mucciardi et al. | |
| 2005/0163680 | A1 | 7/2005 | Le | |
| 2005/0211418 | A1 | 9/2005 | Kenney et al. | |
| 2007/0076376 | A1 * | 4/2007 | Mongia | G06F 1/20 361/700 |
| 2007/0084593 | A1 | 4/2007 | Besant et al. | |
| 2008/0047690 | A1 * | 2/2008 | Muramatsu | F28D 15/0233 165/104.14 |
| 2010/0243207 | A1 | 9/2010 | Liu et al. | |
| 2011/0008198 | A1 | 1/2011 | Hou | |
| 2012/0018134 | A1 * | 1/2012 | Polk, Jr. | F28F 3/04 165/170 |
| 2013/0098582 | A1 * | 4/2013 | Stark | F28D 15/04 165/104.26 |
| 2013/0189556 | A1 | 7/2013 | Toepfer | |
| 2014/0352934 | A1 | 12/2014 | Barone et al. | |
| 2015/0000874 | A1 | 1/2015 | Veilleux, Jr. et al. | |

FOREIGN PATENT DOCUMENTS

| | | | | |
|---|---|---|---|---|
| GB | 2543790 | A * | 5/2017 | F28F 3/022 |
| JP | 2008039311 | A * | 2/2008 | F28D 15/0275 |
| SU | 1244469 | A1 | 7/1986 | |
| WO | WO2009131377 | A2 | 10/2009 | |

OTHER PUBLICATIONS

Machine Translation JP2008039311A (Year: 2008).*
Combined Search and Examination Report, dated Nov. 19, 2014, for Great Britain Patent Application No. GB1409328.0, 6 pages.

* cited by examiner

HEAT EXCHANGER WITH EMBEDDED HEAT PIPES

CROSS-REFERENCE TO RELATED APPLICATION(S)

This application claims priority to U.S. application Ser. No. 13/952,287, filed on Jul. 26, 2013, and entitled "Heat Exchanger with Embedded Heat Pipes," the disclosure of which is incorporated by reference in its entirety.

BACKGROUND

Heat exchangers are often used to transfer heat between two fluids. For example, in gas turbine engines, heat exchangers may be used to transfer heat between a relatively cold fuel and relatively hot engine oil.

Various types of heat exchangers are known. Some heat exchangers are formed by a stack of laminates, each with portions therein carved out to allow fluid flow. The layers are brazed together to create sealed cavities within a stack. Alternating layers of the heat exchanger are either relatively hot or cold, such that the two fluids are kept separate and have a large surface area available for heat exchange.

Improvements upon heat exchanger design have dealt with ensuring that the heat exchanger stack can withstand thermal expansion and contraction and other stresses, as well as maximizing thermal transfer.

One such improvement associated with maximizing thermal transfer is the use of a so-called "secondary" surface. The "primary" surface is the surface of the laminate along which the fluid flows. "Secondary" surfaces are often built upon the primary surface to facilitate additional heat transfer. For example, secondary surfaces may include pins, fins, vanes, and other structures.

SUMMARY

A heat exchanger includes a plate with a primary surface arranged along a plane. A plurality of pins are arranged along that primary surface. At least a portion of the pins are hollow along an axis substantially perpendicular to the plane along which the laminate is arranged.

A heat exchanger includes a plurality of heat exchanger plates having primary surfaces. Each of the primary surfaces includes a plurality of hollowed out pins arranged in a pin fin pattern on a plate. Each primary surface also defines an inlet aperture, and an outlet aperture in fluid communication with the inlet aperture. A plurality of heat pipes each has an outer surface defined by several of the plurality of hollowed out pins. A wicking material is arranged within the several hollowed out pins, and a heat transfer fluid at least partially fills each heat pipe.

A method of transferring heat between two fluids includes routing a hot fluid along a primary surface belonging to a first heat exchange laminate. The primary surface is interspersed by a plurality of hollow pin fin heat pipes. Routing the hot fluid along the secondary surfaces causes a heat transfer fluid within the plurality of hollow pin fin heat pipes to change to a vapor state. Additionally, cold fluid is routed along the primary surface belonging to a second heat exchange laminate. The primary surface of the second heat exchange laminate is also interspersed by the same plurality of hollow pin fin heat pipes, causing the heat transfer fluid within the plurality of hollow pin fin heat pipes to condense. The heat transfer fluid is wicked from the second heat exchange laminate towards the first heat exchange laminate, and displaced evaporated heat transfer fluid passes towards the second heat exchange laminate.

DETAILED DESCRIPTION

As will be described with respect to the drawings, a heat exchanger incorporates embedded heat pipes. Embedded heat pipes present many advantages, among which are reduced thermal stresses on the heat exchanger, as well as improved heat transfer between hot and cold layers. The embedded heat pipes are located in a series of secondary surfaces, which can be manufactured using a chemical etching process. By selectively applying maskant and chemically etching the laminates, laminates may be manufactured which have highly defined characteristics.

The manufacture can also include machining, extruding, forming or fusing powder additive manufacturing such as Direct Metal Laser Sintering (DMLS) and electron beam manufacturing (EBM). In some alternative embodiments that are not shown here, heat exchangers can be formed that are made of one homogeneous piece of material. For example, that piece of material may be formed by casting, direct metal laser sintering, e-beam melting, or other forms of additive manufacturing. Additionally, while the embodiments shown herein refer to laminate-type heat exchangers, various other varieties of heat exchangers may incorporate heat exchangers as described below to achieve the benefits described. For example, plate, plate-shell, tube, and tube-shell type heat exchangers may incorporate heat pipes in order to facilitate secondary surface heat exchange.

Figure 1:
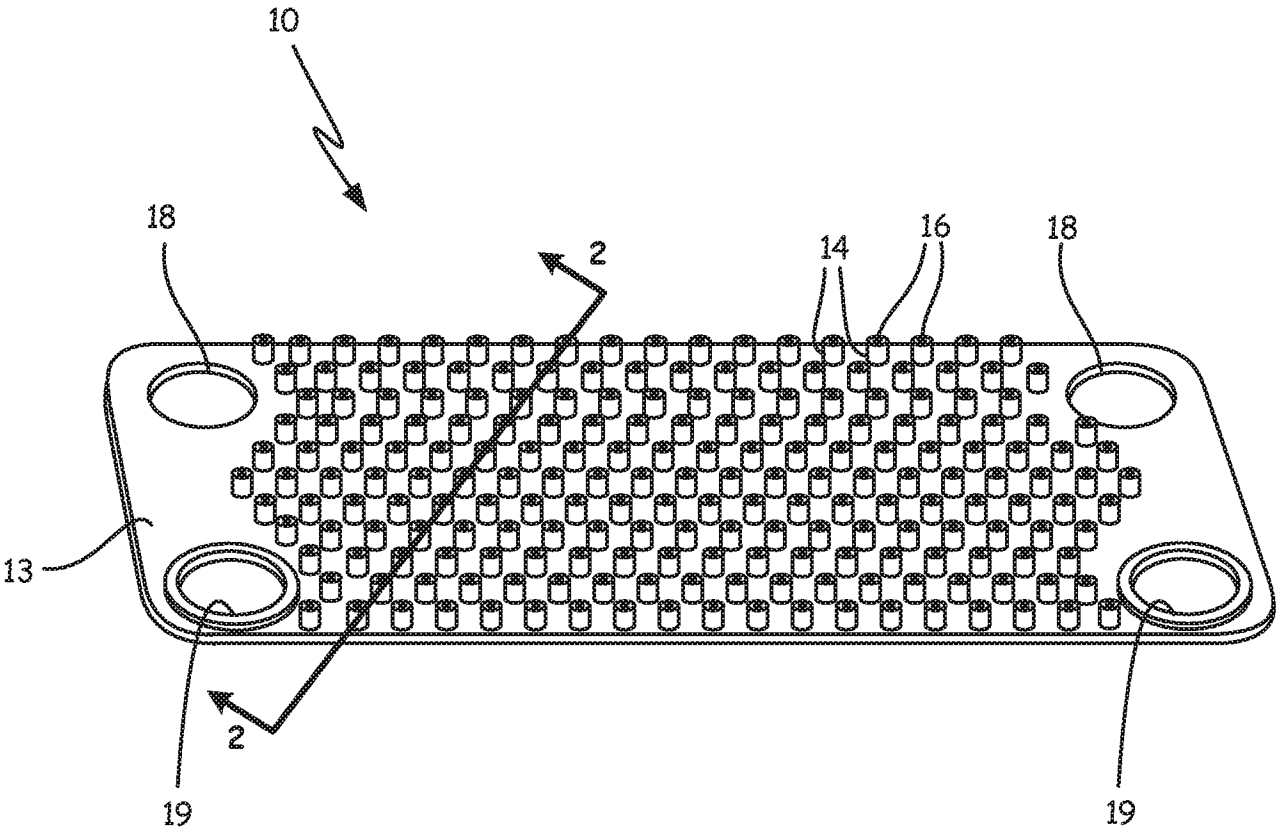
FIG. 1 is a perspective view of a heat exchange laminate having hollow pin fins.

FIG. 1 is a perspective view of heat exchanger laminate 10. Heat exchanger laminate 10 includes plate 12 defining primary surface 13, pins 14, bores 16, open apertures 18, and closed apertures 19. Plate 12 is a metal heat exchanger plate that is arranged along a plane and along which a fluid (not shown) may flow. Pins 14 are formed integrally with plate 12 and extend from primary surface 13 of plate 12, and form a secondary surface for heat transfer, as previously described. Bores 16 are formed within pins 14 and extend through plate 12.

Plate 12 is a substantially flat object, and pins 14 extend substantially perpendicular from the plane along which plate 12 is arranged. Pins 14, as well as bores 16, extend through plate 12. Bores 16 may be used to circumscribe a portion of a heat pipe, as will be described in more detail with respect to FIGS. 3-4. Plate 12 defines primary surface 13, which is a substantially planar surface across one side of plate 12. In other embodiments where the heat exchange structure does not use plates (such as tube-based heat exchangers), a primary surface will be defined along which fluid may flow, which may not necessarily be planar. Secondary surfaces would still extend from the non-planar surface substantially perpendicularly. Thus, in a tube type heat exchanger, the pins with bores defined therein would extend substantially radially from the primary surface.

Open apertures 18 are arranged to introduce and remove working fluid (not shown). In some embodiments, such as the one shown in FIG. 1, one of open apertures 18 is used as a fluid inlet and another of open apertures 18 is used as a fluid outlet. Open apertures 18 are holes in primary surface 13 through which a fluid (not shown) may be routed into or out of the space between heat exchanger laminate 10 and an adjacent laminate, as will be described in more detail with respect to FIGS. 3-4. Open apertures 18 form tanks and/or headers that allow fluid ingress and/or egress from heat exchanger laminate 10. Likewise, closed apertures 19 are holes in primary surface 13 through which fluid may be routed. However, fluid routed through closed apertures 19 is not routed across primary surface 13. In this way, two fluids may be routed through plate 12 without intermixing with one another. For example, it may be advantageous to route a cold fluid through closed apertures 19 while preventing it from intermixing with a hot fluid that is routed through open apertures 18 and across primary surface 13 of plate 12. Such cold fluid could then be routed across a separate structure, such as an additional plate, as described in more detail with respect to FIG. 3.

Heat exchanger laminate 10 of FIG. 1 is made using chemical etching. In the chemical etching process, a metal blank is coated with a pattern of maskant. A corrosive liquid is used to etch unprotected portions of the metal blank in order to form the desired structure of heat exchanger laminate 10, including plate 12, pins 14, bores 16, open apertures 18, and closed apertures 19. In one embodiment, it may be desirable to create all of the bores of several adjacent, aligned laminates using the same technique, so as to ensure alignment of those bores. Thus, bore 16 may be created by drilling after laminate 10 is etched and incorporated into a larger structure (such as heat exchanger 22 of FIGS. 3-4). After bore 16 is drilled, it may be filled with a heat wick material and/or fluid, as described in more detail with respect to FIG. 4.

In operation, one side of plate 12 (e.g., the surface visible in FIG. 1) forms primary surface 13 for heat transfer. Pins 14 form secondary surfaces to facilitate additional heat exchange. Bores 16 through pins 14 allow for the insertion of additional heat transfer mechanisms, such as heat pipes, that employ alternate means of heat transfer.

Figure 2:
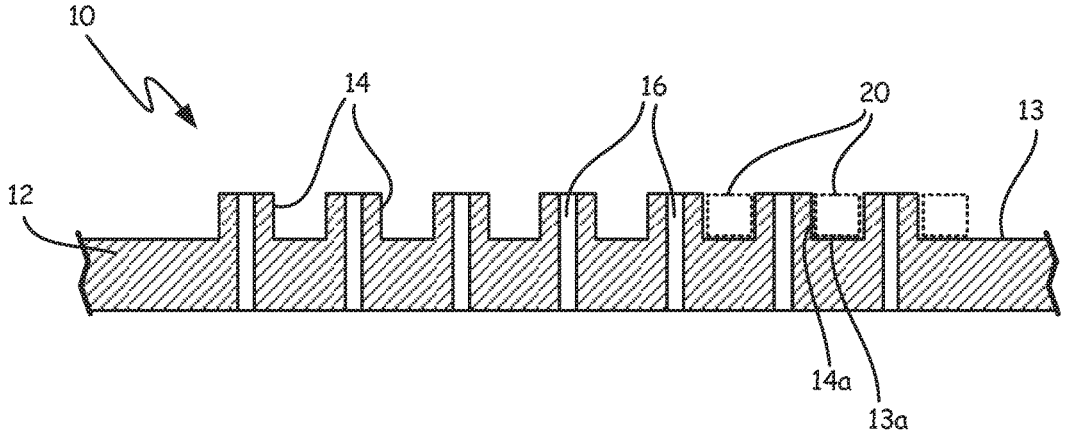
FIG. 2 is a cross-sectional view of the heat exchanger laminate, taken along line 2-2.

FIG. 2 is a cross-sectional view of heat exchanger laminate 10 of FIG. 1, taken along line 2-2. As previously described with respect to FIG. 1, heat exchanger laminate 10 of FIG. 2 includes plate 12, pins 14, and bores 16. FIG. 2 also illustrates flow regions 20, cross-sectional areas of heat exchanger laminate 10 through which fluid may flow.

FIG. 2 shows pins 14 extending from plate 12. In the embodiment shown in FIG. 2, pins 14 extend perpendicular to a plane defined by plate 12. However, in alternative embodiments, pins 14 may extend non-perpendicular to the plane defined by plate 12. Bores 16 extend through both plate 12 and pins 14.

Fluid may flow across plate 12 through flow regions 20. Heat transfer occurs conductively between fluid flowing within flow regions 20 and plate 12 across portion 13*a*, which comprises a section of primary surface 13. Heat transfer that occurs conductively between fluid flowing within flow regions 20 and pins 14 is referred to as conduction through a secondary surface 14*a*. In a typical pin-fin laminated heat exchanger, secondary surfaces may be used to facilitate more heat transfer than would otherwise be possible using only primary surface 13 without any structures built thereon. However, such heat transfer from the secondary surface relies on conduction of heat through the laminate or pins that form the secondary surface. Bores 16 in the embodiment shown in FIG. 2 allow for alternate modes of heat transfer, such as the use of embedded heat pipes, as described in more detail with respect to FIGS. 3-4.

Figure 3:
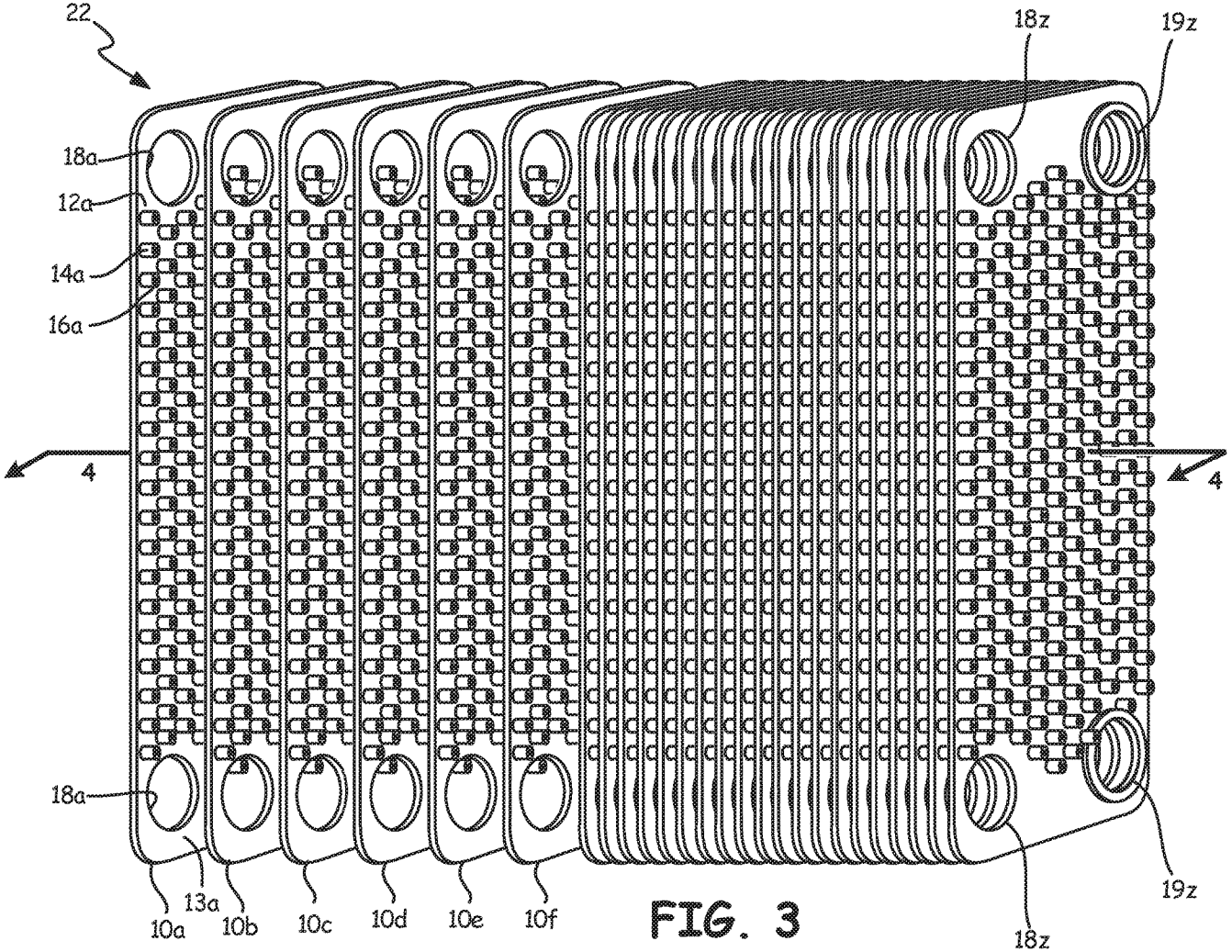
FIG. 3 is an exploded view of a stack of heat exchanger laminates.

FIG. 3 is an exploded view of heat exchanger 22 of heat exchanger laminates 10*a*-10*z*. Each heat exchanger laminate 10*a*-10*z* is connected to adjacent laminates in a stack that forms heat exchanger 22 by brazing. In alternative embodiments, heat exchanger laminates 10*a*-10*z* may be connected by welding, fusing, additive sintering, or other methods. Each of heat exchanger laminates 10*a*-10*z* is similar to heat exchanger laminate 10 of FIGS. 1-2, in that it contains a plate section, pins, bores, and apertures. These features are pointed out with respect to heat exchanger laminate 10*a* as plate section 12*a*, pins 14*a*, bores 16*a*, and open apertures 18*a* (closed apertures 19*a* are not shown as they are hidden underneath adjacent heat exchanger laminate 10*b*, but a facsimile may be seen on heat exchanger laminate 10*z*, closed apertures 19*z*). In the embodiment shown in FIG. 3, there are 26 heat exchanger laminates 10*a*-10*z* in heat exchanger 22. In alternative embodiments, there may be significantly more or fewer laminates in heat exchanger 22. It is common for a heat exchanger to have more or fewer laminates than the embodiment shown in FIG. 3.

As previously alluded to with respect to FIG. 1, open apertures 18*a*-18*z* are open to permit fluid to be routed to the respective primary surface 13*a*-13*z* in which open apertures 18*a*-18*z* are defined. Typically, two open apertures (e.g., 18*a*) are in fluid communication with fluid passing along the associated primary surface (e.g., 13*a*). Meanwhile, closed apertures 19*a*-19*z* are closed off from the fluid path across the respective primary surface 13*a*-13*z* in which closed apertures 19*a*-19*z* are defined. In this way, hot fluids and cold fluids may be kept from intermixing within heat exchanger 22. Open apertures 18*a*-18*z* and closed apertures 19*a*-19*z* may be selectively positioned to maximize the number of primary surfaces 13*a*-13*z* across which a heat gradient exists, while preventing excessive thermal stresses. Many patterns for heat exchange fluid flowpaths are known, including parallel-flow, counter-flow, and cross-flow. Any or all of these heat exchange flowpaths may be utilized in various embodiments of heat exchangers incorporating the invention. In the embodiment shown in FIG. 3, a cross-flow flowpath is illustrated.

Heat exchanger 22 is used to transfer heat between fluids passing through alternating laminates. For example, hot fluid is routed across first heat exchanger laminate 10*a* and second heat exchanger laminate 10*b*, and cold fluid is routed across third heat exchanger laminate 10*c* and fourth heat exchanger laminate 10*d*, as described in more detail with respect to FIG. 4. In alternative embodiments, various patterns of interleaved hot and cold layers are possible. Different arrangements of hot and cold layers exhibit specific advantages with respect to thermal stresses placed upon heat exchanger 22, as well as the effectiveness of heat transfer between layers.

Some heat exchangers may interleave hot and cold heat exchange laminates, plates, or other heat exchange structures in order to form alternating layers of hot and cold fluid-filled cavities (i.e., Hot-Cold-Hot-Cold-Hot-Cold . . . ). This pattern creates the maximum number of laminates or plates across which there is a heat exchange gradient. However, it also creates substantial thermal stresses on the heat exchange stack. Thus, a different pattern of hot and cold laminates are shown in FIG. 3 that reduce the thermal stresses on heat exchanger 22, while maintaining sufficient heat transfer. It has been found that interleaved pairs of hot and cold (i.e., Hot-Hot-Cold-Cold-Hot-Hot-Cold-Cold . . . ) allow for highly efficient heat transfer using heat pipes, while not overly stressing heat exchanger 22. Other common arrangements involving heat pipes may include stacking arrangements having various other patterns of hot and cold heat exchange primary surfaces, depending upon fluid and temperature requirements.

Heat exchanger laminates 10*a*-10*z* are arranged such that the pins of each of laminates 10*a*-10*z* and their corresponding bores are aligned. Thus, a portion of the bores, corresponding to one bore in each of heat exchanger laminates 10*a*-10*z*, forms a hollowed out channel extending from one end of heat exchanger 22 (at heat exchanger laminate 10*a*) to the other (at heat exchanger laminate 10*z*) along a single axis. Various other subsets of the bores may form additional channels along other axes.

The bores that form any particular channel through heat exchanger 22 may be filled with another material, for example a heat wick and/or heat transfer fluid. In this way, heat transfer may be facilitated by modes other than conduction. For example, heat pipes utilize phase change of the heat transfer fluid therein to transfer energy between hot and cold layers of heat exchanger stacks. By filling a portion of the bores that form a channel with heat wick materials, a heat pipe is formed that transects the alternating hot and cold layers of fluid in heat exchanger 22.

Figure 4:
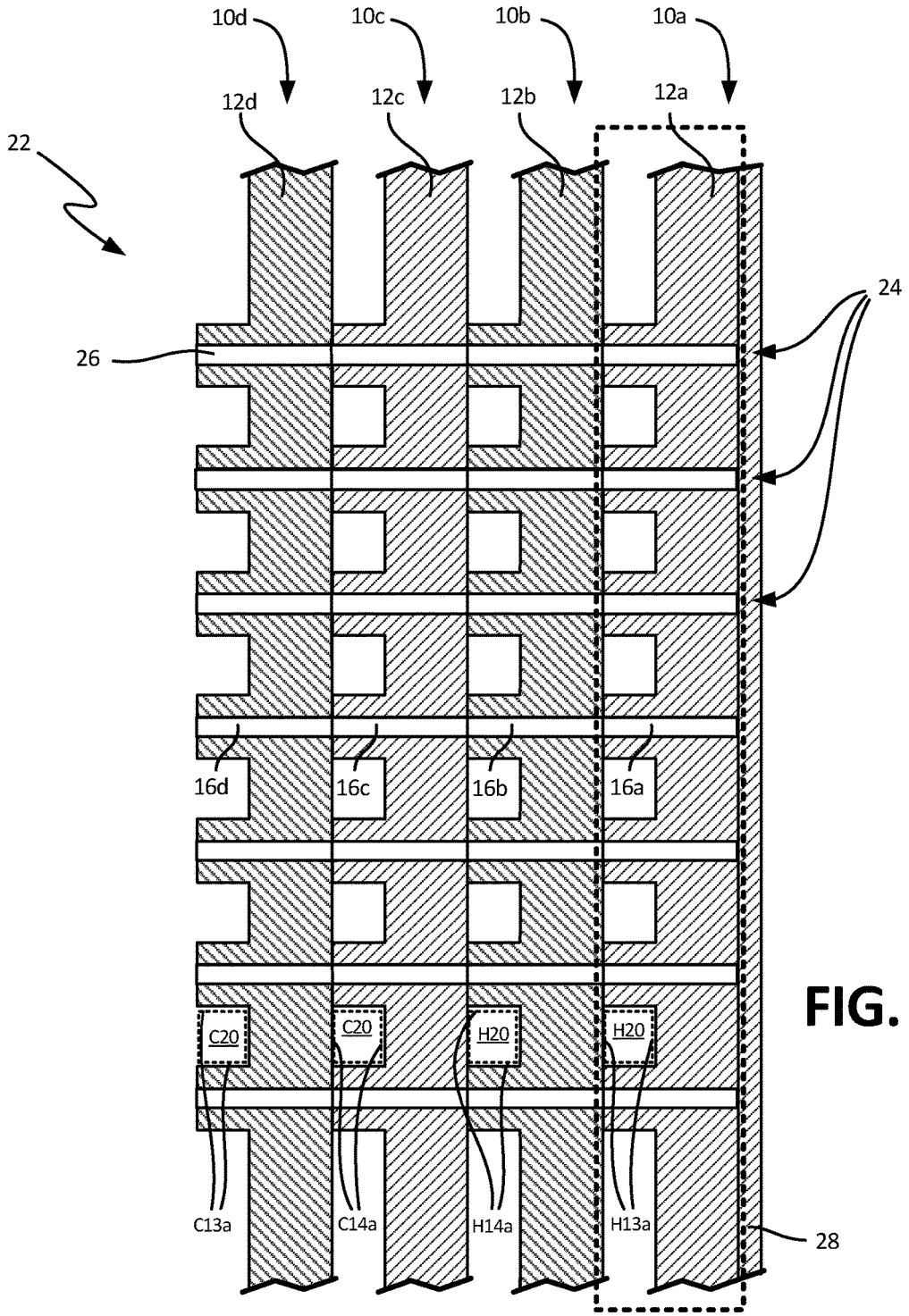
FIG. 4 is a cross-sectional view of the stack of heat exchanger laminates, taken along line 4-4.

FIG. 4 is a cross-sectional view of heat exchanger 22 taken along line 4-4. FIG. 4 has been simplified to show only four adjacent laminates, laminates 10*a*-10*d*. As described with respect to FIG. 3, heat exchangers may include many more heat exchanger laminates with varying stack heights and arrangements. Heat exchanger 22 includes cold flow regions C20 bounded by cold primary surfaces C13*a* and cold secondary surfaces C14*a*. Heat exchanger 22 further includes hot flow regions H20 bounded by hot primary surfaces H13*a* and hot second surfaces H14*a*. FIG. 4 also shows heat pipes 24 filled with heat wick 26. Heat wick 26 has dimensions defined by the outer surface of a portion of the plurality of hollowed out pins 14*a*-14*z*, and includes a wicking material arranged within the hollowed out pins and a heat transfer fluid at least partially filling the pipe. The heat transfer fluid is selected based on the expected operating temperature of the heat pipe, but may be, for example, water, propylene glycol, a halocarbon, or a molten salt.

Heat pipes 24 are the combination of several bores 16 (FIGS. 1-2) stacked end to end in adjacent heat exchange laminates 10*a*-10*d*, and filled with heat wick 26. As shown in FIG. 4, heat exchange laminates 10*a*-10*d* are brazed together. In this way, fluid may be routed between the adjacent laminates, and the gap between the primary surface of each laminate and the adjacent laminate is hermetically sealed. In the embodiment shown in FIG. 4, hot fluid is routed through heat exchange laminate 10*a* and heat exchange laminate 10*b*. Hot fluid passes through hot flow regions H20. Heat may be transferred conductively from fluid travelling through hot flow regions H20 via hot primary surfaces H13*a*. Likewise, cold fluid is routed through heat exchange laminate 10*c* and heat exchange laminate 10*d*. Cold fluid passes through cold flow regions C20. Heat is transferred conductively to the fluid travelling through cold flow regions C20 via cold primary surfaces C13*a*.

As between certain adjacent laminates, heat transfer may take place conductively through the primary surface of the laminate. For example, in the embodiment shown in FIG. 4, heat transfer between cold and hot fluids may occur conductively via heat exchange plate 12*c*. However, embedded heat pipes 24 allow for more efficient heat transfer. Heat wick 26 includes a fluid and a wicking material. In one embodiment, the heat transfer fluid of heat wick 26 evaporates at the temperature of the fluid passing through hot flow regions H20, and condenses at the temperature of the fluid passing through cold flow regions C20. As the fluid of heat wick 26 evaporates, condensed heat transfer fluid takes its place due to capillary action. This in turn displaces evaporated heat transfer fluid. This cycle continues, causing heated, evaporated heat transfer fluid to come into thermal contact with cold second surfaces C14*a* and wicking condensed heat transfer fluid into contact with hot second surfaces H14*a*. Heat pipes 24 are sealed to prevent ingress or egress of foreign material or fluid on both ends. As shown in FIG. 4, cap 28 is placed over the end of heat pipes 24.

Heat pipes 24 give heat exchanger 22 numerous advantages over those known in the prior art. First, they result in significantly reduced thermal stresses on heat exchanger 22. Conductive heat transfer can result in large temperature differences between proximate components. Heat pipes generally have a nearly uniform temperature throughout. Furthermore, heat pipes 24 present an advantage in that they increase the quantity of heat transfer possible per unit volume of the heat exchanger. Thus, heat pipes 24 may allow for reduced heat exchanger size and weight. In many applications, such as those in aerospace, reduced weight and/or increased efficiency are extremely desirable.

Heat exchanger 22 shown in FIG. 4 is made of a stack of heat exchange laminates 10*a*-10*d* with preformed bores 16*a*-16*d*. However, heat exchanger stacks may be fabricated in which bores are not present at the time the laminates are brazed together. In such embodiments, heat pipes 24 may be fabricated by drilling through aligned pins (e.g. 14, FIGS. 1-3). The drilled out pins can then be filled with a wicking material and a heat transfer fluid to form heat pipes similar to those shown as 24 in FIG. 4. Alternatively the holes can be created during the manufacturing when using additive processes such as DMLS or EBM.

Discussion of Possible Embodiments

The following are non-exclusive descriptions of possible embodiments of the present invention.

A heat exchange structure includes a plate arranged along a plane. The plate defines a primary surface. A plurality of pins are arranged along the primary surface. At least a portion of the plurality of pins are hollow along an axis substantially perpendicular to the plane.

Optionally, the heat exchange structure may also include an inlet aperture and an outlet aperture. The heat exchange structure may also include a wick material within the hollowed out pins.

In another embodiment, a heat exchanger includes a plurality of plates having primary surfaces. Each of the primary surfaces defines an inlet aperture and an outlet aperture. The outlet aperture is in fluid communication with the inlet aperture. A plurality of secondary surfaces are arranged on the primary surfaces. The plurality of secondary surfaces include a plurality of hollowed out pins arranged in a pin fin pattern. The plurality of secondary surfaces also include a plurality of heat pipes. Each of the heat pipes includes an outer surface defined by several of the plurality of hollowed out pins, a wicking material arranged within the several hollowed out pins, and a heat transfer fluid at least partially filling the heat pipe.

The heat exchanger may have a plurality of plates that are brazed together in a stack. The plurality of plates may comprise a stack of continuous homogeneous material. The stack of continuous homogeneous material may be formed by either casting, direct metal laser sintering, or e-beam melting. The inlet apertures of each of a first group of the plurality of plates may be coupled to a hot fluid source, and the inlet apertures of each of a second group of the plurality of plates may be coupled to a cold fluid source. The first group of the plurality of plates may comprise pairs of adjacent plates of the stack. The second group of the plurality of plates may include pairs of adjacent plates of the stack, and the pairs of plates of the second group may be interleaved with the pairs of plates in the first group. The hot fluid source may be fuel, oil, or air. Likewise, the cold fluid source may be fuel, oil or air. The plurality of heat pipes may be hermetically sealed. The heat exchanger may also include a cap that seals the plurality of heat pipes on an end of the stack. Several of the hollowed out pins of the plurality of plates may be aligned to define each of the plurality of heat pipes.

A method of transferring heat between two fluids includes routing a hot fluid along a primary surface belonging to a first heat exchange laminate, the primary surface interspersed by a plurality of hollow pin fin heat pipes, causing a heat transfer fluid within the plurality of hollow pin fin heat pipes to evaporate. The method also includes routing a cold fluid along a second surface belonging to a second heat exchange laminate, the second surface interspersed by the plurality of hollow pin fin heat pipes, causing the heat transfer fluid within the plurality of hollow pin fin heat pipes to condense. The method also includes wicking condensed heat transfer fluid from the second heat exchange laminate towards the first heat exchange laminate, and allowing displaced evaporated heat transfer fluid to pass towards the second heat exchange laminate.

A stack may include the first heat exchange laminate, the second heat exchange laminate, and a plurality of additional heat exchange laminates. The method may also include routing the hot fluid to a first group of heat exchange laminates, and routing the cold fluid to a second group of heat exchange laminates. The first group of heat exchange laminates may include several pairs of adjacent heat exchange laminates selected from the plurality of additional heat exchange laminates. A stack of continuous homogeneous material may be formed by one of the group consisting of: casting, direct metal laser sintering, or e-beam melting. The second group of heat exchange laminates may include several pairs of adjacent heat exchange laminates selected from the plurality of additional heat exchange laminates and interleaved with the first group of heat exchange laminates.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A method of transferring heat between two fluids, the method comprising:

routing a hot fluid along a first planar heat exchange primary surface interspersed with a first plurality of hollowed out pins that extend perpendicularly from and are integrally formed with the first planar heat exchange primary surface;

routing a cold fluid along a second planar heat exchange primary surface interspersed with a second plurality of hollowed out pins that extend perpendicularly from and are integrally formed with the second planar heat exchange primary surface, wherein the first plurality of hollowed out pins and the second plurality of hollowed out pins are aligned to form a plurality of hollow pin fin heat pipes;

vaporizing a heat transfer fluid in the plurality of hollow pin fin heat pipes at the first planar heat exchange primary surface;

condensing the heat transfer fluid in the plurality of hollow pin fin heat pipes at the second planar heat exchange primary surface; and wicking condensed heat transfer fluid from the second planar heat exchange primary surface towards the first planar heat exchange primary surface, and allowing displaced evaporated heat transfer fluid to pass towards the second planar heat exchange primary surface.

2. The method of claim 1, wherein a stack includes the first planar heat exchange primary surface, the second planar heat exchange primary surface, and a plurality of additional planar heat exchange primary surfaces.

3. The method of claim 2, and further comprising:

routing the hot fluid to a first group of planar heat exchange primary surfaces; and routing the cold fluid to a second group of planar heat exchange primary surfaces.

4. The method of claim 3, wherein the first group of planar heat exchange primary surfaces comprises several pairs of adjacent heat exchange laminates selected from the plurality of additional planar heat exchange primary surfaces.

5. The method of claim 4, wherein the second group of planar heat exchange primary surfaces comprises several pairs of adjacent heat exchange laminates selected from the plurality of additional planar heat exchange primary surfaces and interleaved with the first group of planar heat exchange primary surfaces.

6. A method of transferring heat between two fluids, the method comprising:

routing a hot fluid along a plurality of first planar heat exchange primary surfaces interspersed with hollowed out pins that are integrally formed with each of the plurality of the first planar heat exchange primary surfaces;

routing a cold fluid along a plurality of second planar heat exchange primary surfaces interspersed with hollowed out pins that are integrally formed with each of the plurality of second planar heat exchange primary surfaces, wherein the hollowed out pins of the plurality of first planar heat exchange primary surfaces and the hollowed out pins of the plurality of second planar heat exchange primary surfaces are aligned to form a plurality of hollow pin fin heat pipes;

vaporizing a heat transfer fluid in the plurality of hollow pin fin heat pipes at one of the first planar heat exchange primary surfaces;

condensing the heat transfer fluid in the plurality of hollow pin fin heat pipes at one of the second planar heat exchange primary surfaces; and wicking condensed heat transfer fluid from the plurality of second planar heat exchange primary surfaces towards the plurality of first planar heat exchange primary surfaces, and allowing displaced evaporated heat transfer fluid to pass towards the plurality of second planar heat exchange primary surfaces.

7. The method of claim 6, and further comprising:

routing the hot fluid to a first group of planar heat exchange primary surfaces; and routing the cold fluid to a second group of planar heat exchange primary surfaces.

8. The method of claim 7, wherein the first group of planar heat exchange primary surfaces comprises several pairs of adjacent heat exchange laminates from the plurality of planar heat exchange primary surfaces.

9. The method of claim 8, wherein the second group of planar heat exchange primary surfaces comprises several pairs of adjacent heat exchange laminates from the plurality of planar heat exchange primary surfaces and interleaved with the first group of planar heat exchange primary surfaces.

* * * * *